US012173711B2

(12) United States Patent
Fujiwara et al.

(10) Patent No.: US 12,173,711 B2
(45) Date of Patent: Dec. 24, 2024

(54) ELECTRIC COMPRESSOR

(71) Applicant: KABUSHIKI KAISHA TOYOTA JIDOSHOKKI, Aichi (JP)

(72) Inventors: Ami Fujiwara, Kariya (JP); Takuro Yamashita, Kariya (JP); Tsuyoshi Yamaguchi, Kariya (JP); Yoichi Takashima, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 18/436,382

(22) Filed: Feb. 8, 2024

(65) Prior Publication Data

US 2024/0280104 A1 Aug. 22, 2024

(30) Foreign Application Priority Data

Feb. 17, 2023 (JP) ..... 2023-023065

(51) Int. Cl.
*F04C 18/02* (2006.01)
*F04B 39/12* (2006.01)
*F04C 27/00* (2006.01)

(52) U.S. Cl.
CPC ..... *F04C 27/005* (2013.01); *F04C 18/0215* (2013.01); *F04C 2240/30* (2013.01); *F04C 2240/805* (2013.01)

(58) Field of Classification Search
CPC ..... F04C 27/005; F04C 18/0215; F04C 18/0246; F04B 39/121; Y10T 403/75; Y10T 403/70; Y10T 403/79; Y10T 403/7086; Y10T 403/33; Y10T 403/335
See application file for complete search history.

(56) References Cited

U.S. PATENT DOCUMENTS 4,360,317 A 11/1982 Vallance et al.
5,106,279 A * 4/1992 Richardson, Jr. ... F04C 18/0253 418/55.6
2015/0118089 A1* 4/2015 Berning ..... F04C 18/0215 418/55.5
2022/0056898 A1 2/2022 Takabe et al.

FOREIGN PATENT DOCUMENTS

JP 2017155717 A * 9/2017 ..... F04C 29/00
JP 2020-70741 A 5/2020
KR 1020210098140 A 8/2021

OTHER PUBLICATIONS

English JP2017155717 by PE2E Jun. 3, 2024.*
German Office Action in counterpart German Application No. DE 10 2024 100 479.7, dated Sep. 12, 2024 (along with English-language summary thereof).

* cited by examiner

*Primary Examiner* — Deming Wan
(74) *Attorney, Agent, or Firm* — Greenblum & Bernstein, P.L.C.

(57) ABSTRACT

An electric compressor includes a housing including a first housing portion made of metal, the first housing portion having a first joint surface and a first pin hole, a second housing portion made of metal, the second housing portion having a second joint surface and a second pin hole, a connecting pin made of metal, the connecting pin having a press-fitting portion and a first insertion portion having a first contact portion and removably inserted into the second pin hole, and a first gasket having an insulation property, the first gasket having a first pin insertion hole, the first gasket being interposed between the first joint surface and the second joint surface.

6 Claims, 5 Drawing Sheets

ELECTRIC COMPRESSOR

BACKGROUND ART

This application claims priority to Japanese Patent Application No. 2023-023065 filed on Feb. 17, 2023, the entire disclosure of which is incorporated herein by reference.

The present disclosure relates to an electric compressor.

Japanese Patent Application Publication No. 2020-070741 discloses an example of a conventional electric compressor. In this electric compressor, a compression mechanism and a motor mechanism are accommodated in a housing.

The housing has a first housing portion made of metal, a second housing portion made of metal, a gasket having an insulation property and interposed between the first housing portion and the second housing portion, and an insertion member made of metal.

A first insertion hole is formed in a joint surface in the first housing portion with the second housing portion, and one end portion of the insertion member is inserted into the first insertion hole. A second insertion hole is formed in a joint surface in the second housing portion with the first housing portion at a position where the second injection hole faces the first insertion hole, and the other end portion of the insertion member is inserted into the second insertion hole. An insertion hole is formed in the gasket and located at a position in correspondence with the first insertion hole and the second insertion hole. The insertion member is inserted through the insertion hole of the gasket.

The insertion member is formed by bending a thin plate so as to be a cylindrical shape, and has an approximately C-shape when viewed in an axial direction of the insertion member. The insertion member has an outer diameter larger than inner diameters of the first insertion hole and the second insertion hole when no force is applied to the insertion member.

In this electric compressor, the one end portion of the insertion member is inserted into the first insertion hole while the one end portion is elastically deformed to reduce the outer diameter of the one end portion, and the other end portion of the insertion member is inserted into the second insertion hole while the other end portion is elastically deformed to reduce the outer diameter of the other end portion. With this insertion, the inner peripheral surfaces of the first insertion hole and the second insertion hole are pressed by an elastic force in an outer peripheral surface of the insertion member. As a result, the first housing portion and the second housing portion are electrically connected through the insertion member with certainty, which ensures that the first housing portion and the second housing portion have the same electric potential.

However, in the above-described conventional electric compressor, the insertion member is inserted into the first insertion hole and the second insertion hole while being elastically deformed. Accordingly, when the housing is disassembled for maintenance or the like, a large force is required to remove the second housing portion from the first housing portion depending on a magnitude of the elastic force in the insertion member. This may make the removing work difficult.

The present disclosure has been made in view of the above-described conventional circumstances, and provides an electric compressor in which a housing as a whole has the same electric potential while an ease of disassembly of the housing is maintained.

SUMMARY

In accordance with an aspect of the present disclosure, there is provided an electric compressor that includes a housing accommodating a compression mechanism and a motor mechanism. The housing includes: a first housing portion made of metal, the first housing portion having a first joint surface and a first pin hole formed in the first joint surface; a second housing portion made of metal, the second housing portion having a second joint surface that faces the first joint surface and a second pin hole formed in the second joint surface at a position in correspondence with the first pin hole; a connecting pin made of metal, the connecting pin having a press-fitting portion press-fitted into the first pin hole and a first insertion portion having a first contact portion protruding from an outer peripheral surface of the first insertion portion and removably inserted into the second pin hole, the first contact portion being in contact with an inner peripheral surface of the second pin hole; and a first gasket having an insulation property, the first gasket having a first pin insertion hole through which the connecting pin is inserted, the first gasket being interposed between the first joint surface and the second joint surface.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe a first embodiment and a second embodiment according to the present disclosure with reference to the drawings.

First Embodiment

Figure 1:
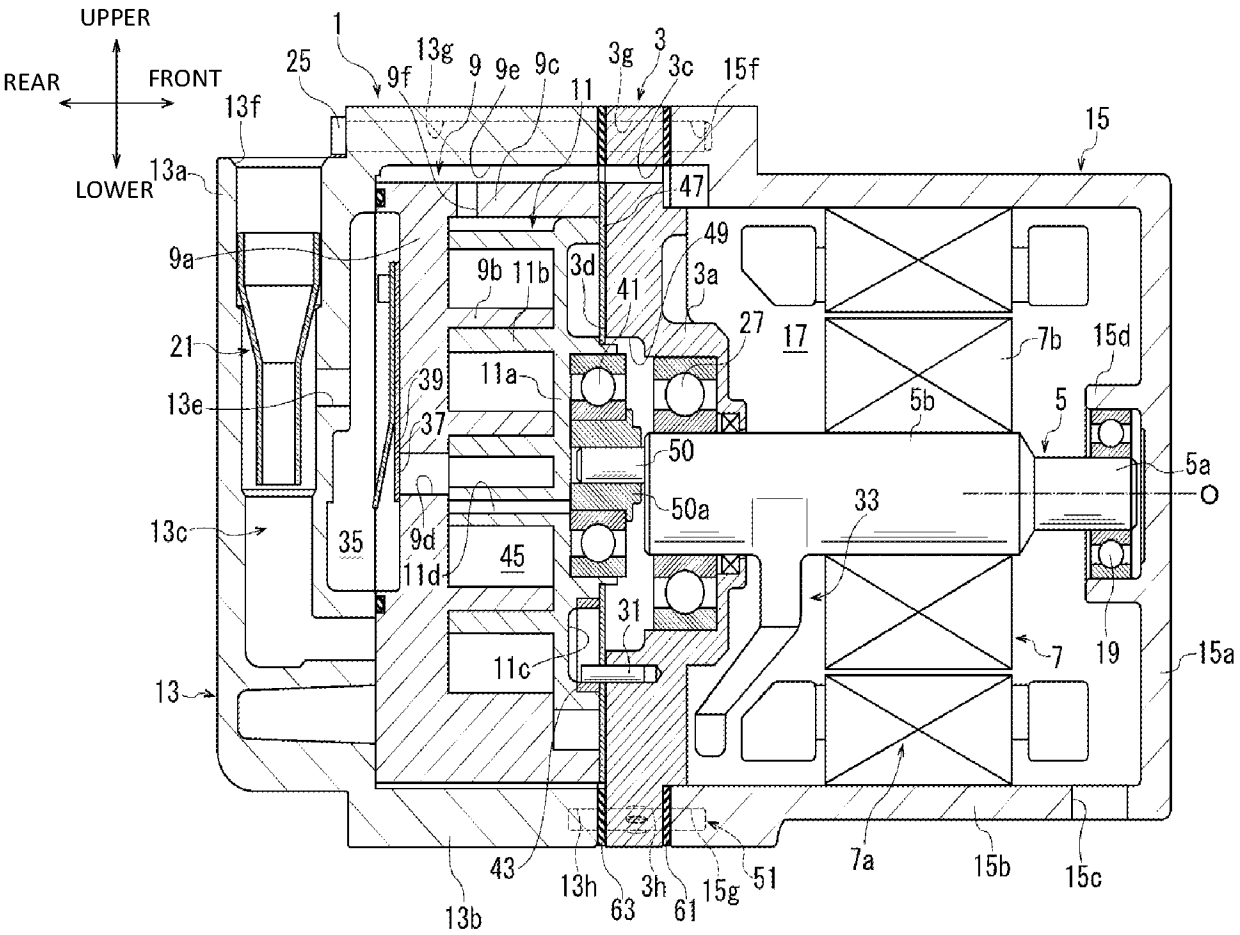
FIG. 1 is a cross-sectional view of an electric compressor according to a first embodiment.

An electric compressor (hereinafter, simply called the compressor) of the first embodiment is an electric compressor for a vehicle air conditioner, as illustrated in FIG. 1. This compressor includes a housing 1, a driving shaft 5, a motor mechanism 7, a fixed scroll 9, a movable scroll 11, and an elastic plate 47.

The housing 1 has a motor housing 15, a first gasket 61, a shaft supporting housing 3, a second gasket 63, a compression part housing 13, connecting pins 51, and bolts 25.

The motor housing 15 is an example of the "first housing portion" in the present disclosure. The shaft supporting housing 3 is an example of the "second housing portion" in the present disclosure. The compression part housing 13 is an example of the "third housing portion" in the present disclosure. The driving shaft 5, the fixed scroll 9, the movable scroll 11, and the elastic plate 47 are an example of the "compression mechanism" in the present disclosure. Each of the bolts 25 is an example of the "fastening member" in the present disclosure.

In the present embodiment, as illustrated in FIG. 1, a front and rear direction is defined as follows: a side on which the motor housing 15 is located is the front side of the compressor and a side on which the compression part housing 13 is located is the rear side of the compressor. A vertical direction of the compressor is also defined as illustrated in FIG. 1. These directions correspond to an example for ease of explanation, and a posture of the compressor is changed as appropriate in correspondence with a vehicle on which the compressor is mounted, or the like.

Figure 2:
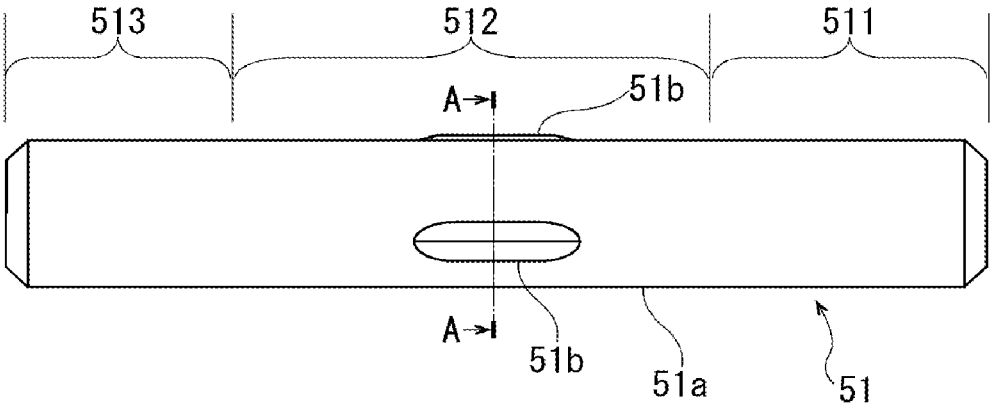
FIG. 2 is a front view of a connecting pin in the electric compressor according to the first embodiment.
Figure 3:
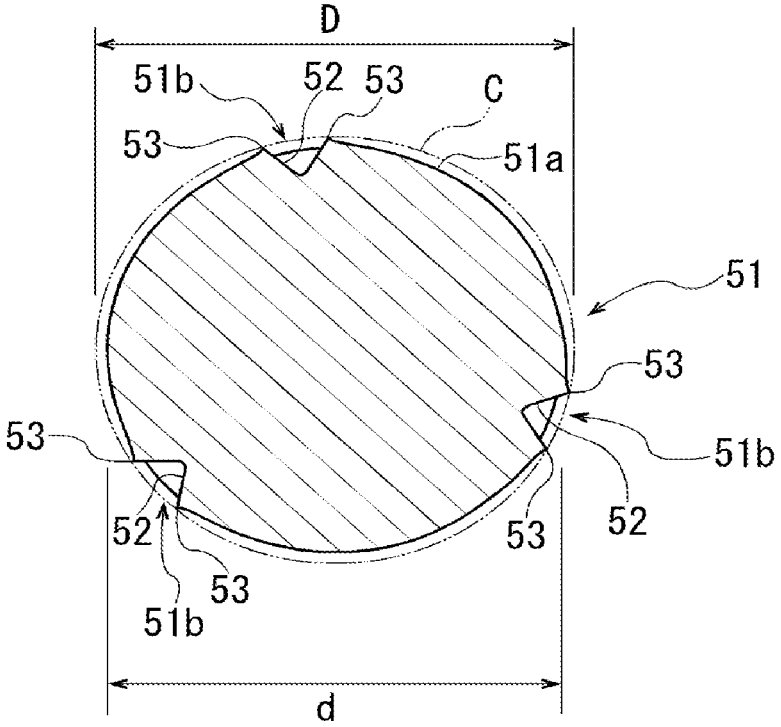
FIG. 3 is a cross-sectional view taken along a line A-A of FIG. 2 in the electric compressor according to the first embodiment.
Figure 4:
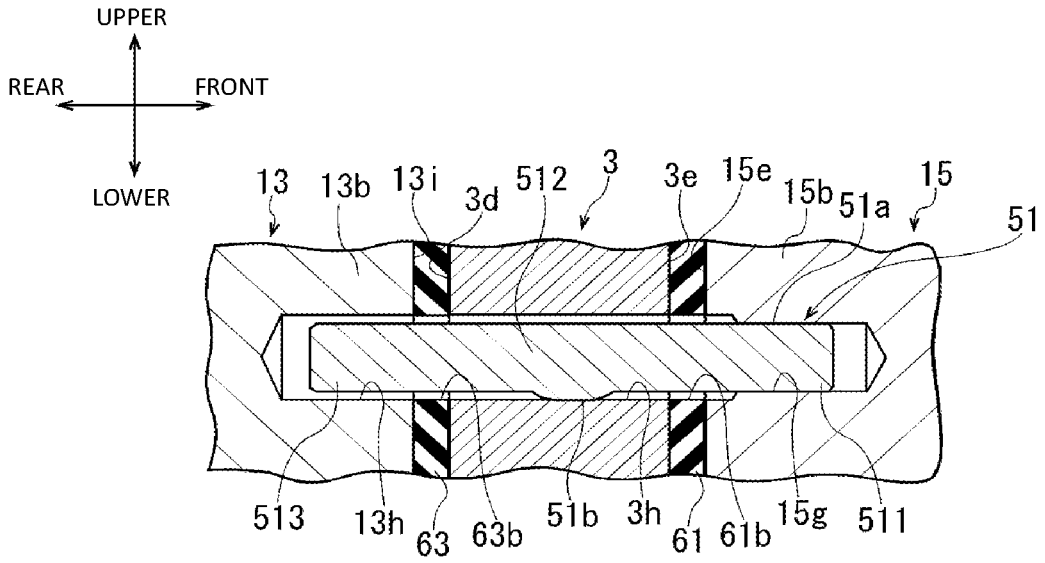
FIG. 4 is an enlarged cross-sectional view partially illustrating a connecting pin and a vicinity of the connecting pin in the electric compressor according to the first embodiment.

As illustrated in FIGS. 2 to 4, each of the connecting pins 51 is made of metal and has a substantially cylindrical shape. The connecting pin 51 has an outer peripheral surface 51*a* having a cylindrical shape with an outer diameter d and three first contact portions 51*b* that are located in a middle portion of the connecting pin 51 in a longitudinal direction thereof and protrude outwardly in a radial direction of the connecting pin 51 from the outer peripheral surface 51*a*. The three first contact portions 51*b* are arranged at regular intervals of 120 degrees in a circumferential direction of the outer peripheral surface 51*a*. A diameter D of a circumcircle C of the three first contact portion 51*b*, that is, the diameter D of the circumcircle C that is in contact with protrusion ends of protrusions 53, which are described later, is larger than the outer diameter d of the outer peripheral surface 51*a*.

The first contact portions 51*b* are formed by a metal stamping of predetermined positions on the outer peripheral surface 51*a*. The first contact portions 51*b* each have a groove 52 recessed in the outer peripheral surface 51*a*and extending in the longitudinal direction of the connecting pin 51 and the pair of protrusions 53 protruded on the outer peripheral surface 51*a*, extending in the longitudinal direction of the connecting pin 51, and arranged side by side in the circumferential direction of the outer peripheral surface 51*a* with the groove 52 interposed therebetween.

The connecting pin 51 has a press-fitting portion 511, a first insertion portion 512, and a second insertion portion 513, which are arranged in this order from one end toward the other end of the connecting pin 51 in the longitudinal direction thereof. The press-fitting portion 511 and the second insertion portion 513 are formed as so-called straight portions extending with the constant outer diameter d in the longitudinal direction of the connecting pin 51 and located in opposite end portions of the connecting pin 51 in the longitudinal direction thereof. The first insertion portion 512 is formed in the middle portion of the connecting pin 51 in the longitudinal direction thereof, and the three first contact portions 51*b* are formed on the outer peripheral surface 51*a* in the first insertion portion 512.

Figure 5:
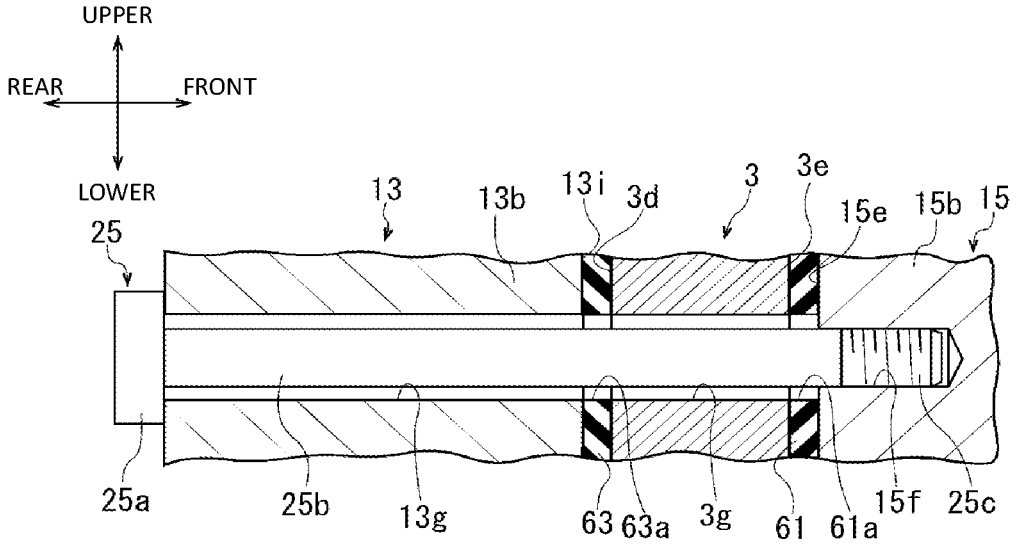
FIG. 5 is an enlarged cross-sectional view partially illustrating a fastening member and a vicinity of the fastening member in the electric compressor according to the first embodiment.

As illustrated in FIG. 5, the bolt 25 is made of metal and has a head 25*a*and a shank 25*b* formed integrally with the head 25*a*. An external threaded portion 25*c* is formed in an end portion of the shank 25*b*.

As illustrated in FIG. 1, the motor housing 15 is formed in a bottomed tubular shape and has a front wall 15*a* and a first peripheral wall 15*b*. The front wall 15*a* is located at a front end of the motor housing 15 and extends in a radial direction of the motor housing 15. The first peripheral wall 15*b* extends from the front wall 15*a* rearward in a direction in which a driving axis O of the driving shaft 5 extends. The front wall 15*a* cooperates with the first peripheral wall 15*b* to form a motor chamber 17 in the motor housing 15. The driving axis O extends in parallel with the front and rear direction of the compressor.

A suction port 15*c* is formed in the first peripheral wall 15*b* of the motor housing 15 and connects the motor chamber 17 to an evaporator, which is not illustrated. Refrigerant being fluid flowing through the evaporator is suctioned into the motor chamber 17 through the suction port 15*c*. That is, the motor chamber 17 also serves as a suction chamber.

A supporting portion 15*d* is formed in the front wall 15*a* of the motor housing 15 and protrudes from the front wall 15*a* toward the motor chamber 17. The supporting portion 15*d* is formed in a cylindrical shape and has a first radial bearing 19 therein.

As illustrated in FIGS. 4 to 7, six bottomed internal screw holes 15*f* are formed in a rear end surface 15*e* of the first peripheral wall 15*b*, and the external threaded portions 25*c* of the bolts 25 are screwed into the internal screw holes 15*f*. The rear end surface 15*e* is an example of the "first joint surface" in the present disclosure. The internal screw holes 15*f* are arranged at regular intervals of 60 degrees in a circumferential direction of the first peripheral wall 15*b*. In addition, two bottomed first pin holes 15*g* are formed in the rear end surface 15*e* of the first peripheral wall 15*b*. The first pin holes 15*g* are arranged at 180-degree apart in the circumferential direction of the first peripheral wall 15*b*. Each of the first pin holes 15*g* is formed in a circle when viewed in a cross-sectional view, and has an inner diameter smaller than the outer diameter d of the outer peripheral surface 51*a* of the connecting pin 51, that is, the outer diameter d of the outer peripheral surface 51*a* in the press-fitting portion 511. This means that the press-fitting portion 511 of the connecting pin 51 is press-fitted into the first pin hole 15*g*.

As illustrated in FIG. 1, the shaft supporting housing 3 is disposed between the motor housing 15 and the compression part housing 13. Six first bolt insertion holes 3*g* are formed in an outer peripheral edge portion of the shaft supporting housing 3 and located at positions in correspondence with the internal screw holes 15*f* of the first peripheral wall 15*b* in a circumferential direction of the shaft supporting housing 3. The first bolt insertion holes 3*g* extend through the shaft supporting housing 3 in the front and rear direction of the compressor. The first bolt insertion holes 3*g* each have an inner diameter larger than an outer diameter of the shank 25*b* of the corresponding bolt 25.

In addition, two second pin holes 3*h* are formed in the outer peripheral edge portion of the shaft supporting housing 3 and located at positions in correspondence with the first pin holes 15*g* of the first peripheral wall 15*b* in a circumferential direction of the shaft supporting housing 3. The shaft supporting housing 3 has a front end surface 3*e* that faces the rear end surface 15*e* of the motor housing 15 and the second pin holes 3*h* formed in the front end surface 3*e* at positions where the second pin holes 3*h* face the first pin holes 15*g* of the first peripheral wall 15*b*. The second pin holes 3*h* extend through the shaft supporting housing 3 in the front and rear direction of the compressor. Each of the second pin holes 3*h* is formed in a circle when viewed in a cross-sectional view, and has an inner diameter larger than the outer diameter d of the outer peripheral surface 51*a* of the connecting pin 51 and equal to the diameter D of the circumcircle C of the first contact portions 51*b*. That is, the protrusions 53 of the first contact portions 51*b* formed in the first insertion portion 512 of the connecting pin 51 are in contact with an inner peripheral surface of the second pin hole 3*h*, and the first insertion portion 512 is removably inserted into the second pin hole 3*h*.

The compression part housing 13 is formed in a bottomed tubular shape and has a rear wall 13*a* and a second peripheral wall 13*b*. The rear wall 13*a* is located at a rear end of the compression part housing 13 and extends in a radial direction of the compression part housing 13. The second peripheral wall 13*b* extends from the rear wall 13*a* frontward in the direction in which the driving axis O extends.

Six second bolt insertion holes 13*g* are formed also in the second peripheral wall 13*b* of the compression part housing 13 and located at positions in correspondence with the internal screw holes 15*f* of the first peripheral wall 15*b* in the circumferential direction of the compression part housing 13. The second bolt insertion holes 13*g* extend through the compression part housing 13 in the front and rear direction of the compressor. The second bolt insertion holes 13*g* each have an inner diameter larger than the outer diameter of the shank 25*b* of the corresponding bolt 25. In addition, two bottomed third pin holes 13*h* are formed also in the second peripheral wall 13*b* of the compression part housing 13 and located at positions in correspondence with the first pin holes 15*g* of the first peripheral wall 15*b* in the circumferential direction of the compression part housing 13. The compression part housing 13 has a front end surface 13*i* that faces a rear end surface 3*d* of the shaft supporting housing 3 and the third pin holes 13*h* formed in the front end surface 13*i* at positions where the third pin holes 13*h* face the second pin holes 3*h*. Each of the third pin holes 13*h* has a circle when viewed in a cross-sectional view, and has an inner diameter larger than the outer diameter d of the outer peripheral surface 51*a* of the connecting pin 51.

An oil separation chamber 13*c* and a discharge port 13*f* are formed in the compression part housing 13. An oil separation cylinder 21 having a cylindrical shape is fixed in the oil separation chamber 13*c*. A separator is formed of an outer peripheral surface of the oil separation cylinder 21 and an inner peripheral surface of the oil separation chamber 13*c*. The discharge port 13*f* communicates with the oil separation chamber 13*c* and is connected to a condenser, which is not illustrated.

At least surface layers of the first gasket 61 and the second gasket 63 are made of synthetic rubber and have an insulation property. The first gasket 61 is interposed between the rear end surface 15*e* of the motor housing 15 and the front end surface 3*e* of the shaft supporting housing 3 facing the rear end surface 15*e* in the front and rear direction of the compressor to provide a seal between the motor housing 15 and the shaft supporting housing 3. The second gasket 63 is interposed between the rear end surface 3*d* opposite to the front end surface 3*e* of the shaft supporting housing 3 and the front end surface 13*i* of the compression part housing 13 facing the rear end surface 3*d* in the front and rear direction of the compressor to provide a seal between the shaft supporting housing 3 and the compression part housing 13. The front end surface 3*e* of the shaft supporting housing 3 is an example of the "second joint surface" in the present disclosure. The rear end surface 3*d* of the shaft supporting housing 3 is an example of the "third joint surface" in the present disclosure. The front end surface 13*i* of the compression part housing 13 is an example of the "fourth joint surface" in the present disclosure.

Six bolt insertion holes 61*a* are formed in the first gasket 61 and located at positions in correspondence with the internal screw holes 15*f* of the first peripheral wall 15*b* in the circumferential direction of the first gasket 61. Two first pin insertion holes 61*b* are also formed in the first gasket 61 and located at positions in correspondence with the first pin holes 15*g* of the first peripheral wall 15*b* in the circumferential direction of the first gasket 61. Similarly to the first gasket 61, six bolt insertion holes 63*a* are formed in the second gasket 63 and located at positions in correspondence with the internal screw holes 15*f* of the first peripheral wall 15*b* in the circumferential direction of the second gasket 63. Two second pin insertion holes 63*b* are also formed in the second gasket 63 and located at positions in correspondence with the first pin holes 15*g* of the first peripheral wall 15*b* in the circumferential direction of the second gasket 63. An inner diameter of each of the bolt insertion holes 61*a* and an inner diameter of each of the bolt insertion holes 63*a* are larger than the outer diameter of the shank 25*b* of the corresponding bolt 25. An inner diameter of each of the first pin insertion holes 61*b* and an inner diameter of each of the second pin insertion holes 63*b* are larger than the outer diameter d of the outer peripheral surface 51*a* of the connecting pin 51.

The motor housing 15, the shaft supporting housing 3, and the compression part housing 13 are fastened with the plurality of bolts 25 (six in the present embodiment), which are inserted from a side of the compression part housing 13, with the first gasket 61 interposed between the motor housing 15 and the shaft supporting housing 3 and with the second gasket 63 interposed between the shaft supporting housing 3 and the compression part housing 13.

In a fastening state where the motor housing 15 and the compression part housing 13 are fastened with the bolts 25 with the shaft supporting housing 3 interposed therebetween, the heads 25*a* of the bolts 25 are in contact with the compression part housing 13, the shanks 25*b* of the bolts 25 extend through the second bolt insertion holes 13*g* of the compression part housing 13 and the first bolt insertion holes 3*g* of the shaft supporting housing 3 such that the shanks 25*b*are not in contact with the second bolt insertion holes 13*g* and the first bolt insertion holes 3*g*, and the external threaded portions 25*c* of the bolts 25 are screwed into the internal screw holes 15*f* of the motor housing 15. The shanks 25*b* of the bolts 25 extend through the bolt insertion holes 61*a* of the first gasket 61 and the bolt insertion holes 63*a* of the second gasket 63 such that the shanks 25*b* are not in contact with the bolt insertion holes 61*a* and the bolt insertion holes 63*a*.

In the above-described fastening state, the press-fitting portion 511 of each of the connecting pins 51 is press-fitted into the corresponding first pin hole 15*g* of the motor housing 15, the protrusions 53 of the first contact portions 51*b* in the first insertion portion 512 of each of the connecting pins 51 are in contact with the inner peripheral surface of the corresponding second pin hole 3*h* of the shaft supporting housing 3, and the second insertion portion 513 of each of the connecting pins 51 is inserted into the corresponding third pin hole 13*h* of the compression part housing 13 such that the second insertion portion 513 is not in contact with inner peripheral surface of the third pin hole 13*h*.

The shaft supporting housing 3 has a boss 3*a* protruding toward the motor chamber 17. A plurality of anti-rotation pins 31 are fixed on a rear surface side of the shaft supporting housing 3 and extend rearward from the shaft supporting housing 3. A first suction passage 3*c* is formed in an outer peripheral portion of the shaft supporting housing 3 and extends through the shaft supporting housing 3 in the front and rear direction of the compressor.

The driving shaft 5 extends in the direction in which the driving axis O extends and has a small diameter portion 5*a* located near a front end of the driving shaft 5 and a large diameter portion 5*b* located near a rear end of the driving shaft 5. An eccentric pin 50 is fixed on a rear end surface of the large diameter portion 5*b*, and extends rearward at a position eccentric to the driving axis O. The eccentric pin 50 is fitted to a bush 50*a* in the boss 3*a*.

The small diameter portion 5*a* of the driving shaft 5 is rotatably supported by the supporting portion 15*d* of the motor housing 15 through the first radial bearing 19. A rear end portion of the large diameter portion 5*b* is rotatably supported by a second radial bearing 27 in the boss 3*a*. The driving shaft 5 is rotatable around the driving axis O in the housing 1.

The motor mechanism 7 is accommodated in the motor chamber 17. The motor mechanism 7 has a stator 7*a* and a rotor 7*b*. The stator 7*a* is fixed on an inner peripheral surface of the first peripheral wall 15*b*. The stator 7*a* is connected to an inverter (not illustrated) provided outside the motor housing 15.

The rotor 7*b* is disposed in the stator 7*a* and fixed to the large diameter portion 5*b* of the driving shaft 5. The rotor 7*b* rotates in the stator 7*a* to rotate the driving shaft 5 around the driving axis O.

The fixed scroll 9 is fixed to the compression part housing 13 and disposed on an inner peripheral side of the second peripheral wall 13*b*. The fixed scroll 9 has a fixed scroll base plate 9*a*, a fixed scroll spiral wall 9*b*, and an outer peripheral wall 9*c* having a ring shape. The fixed scroll base plate 9*a* is located at a rear end of the fixed scroll 9 and formed in a disc shape. The fixed scroll spiral wall 9*b* is disposed inside the outer peripheral wall 9*c* in a radial direction thereof and extends forward from the fixed scroll base plate 9*a*.

A discharge chamber 35 is formed between a rear surface of the fixed scroll base plate 9*a* and a front surface of the rear wall 13*a* of the compression part housing 13. A discharge port 9*d* is formed in the fixed scroll base plate 9*a*, and extends through the fixed scroll base plate 9*a*. The discharge port 9*d* connects the discharge chamber 35 to a compression chamber 45, which is described later. The discharge chamber 35 communicates with the oil separation chamber 13*c* through a discharge passage 13*e*.

A discharge reed valve 37 and a retainer 39 are attached to the fixed scroll base plate 9*a*. The discharge reed valve 37 and the retainer 39 are disposed in the discharge chamber 35. The discharge reed valve 37 is elastically deformed to open and close the discharge port 9*d*. The retainer 39 adjusts an amount of the elastic deformation of the discharge reed valve 37.

A second suction passage 9*e* is formed between the outer peripheral wall 9*c* and the second peripheral wall 13*b* of the compression part housing 13. A suction port 9*f* is formed in the outer peripheral wall 9*c*, and the second suction passage 9*e* communicates with the compression chamber 45, which is described later, through the suction port 9*f*.

The movable scroll 11 is provided in the compression part housing 13 and located between the fixed scroll 9 and the shaft supporting housing 3. The movable scroll 11 has a movable scroll base plate 11*a* and a movable scroll spiral wall 11*b*. The movable scroll base plate 11*a* is located at a front end of the movable scroll 11 and formed in a disc shape. The bush 50*a* is rotatably supported by the movable scroll base plate 11*a* through a third radial bearing 41. Thus, the movable scroll 11 is connected to the driving shaft 5 at a position eccentric to the driving axis O through the bush 50*a* and the eccentric pin 50.

Anti-rotation holes 11*c* are recessed in the movable scroll base plate 11*a*and end portions of the auto-rotation pins 31 are loosely fitted into the anti-rotation holes 11*c*. Rings 43 each having a cylindrical shape are loosely fitted in the anti-rotation holes 11*c*. When the anti-rotation pins 31 roll while sliding on the inner peripheral surfaces of the rings 43, the rotation of the movable scroll 11 is restricted and the movable scroll 11 makes orbital motion.

The movable scroll spiral wall 11*b* extends rearward from the movable scroll base plate 11*a*. A supply hole 11*d* is opened at a front end of the movable scroll spiral wall 11*b* and located near a center of the movable scroll spiral wall 11*b*. The supply hole 11*d* extends through the movable scroll spiral wall 11*b* and also the movable scroll base plate 11*a* in the front and rear direction of the compressor.

The fixed scroll 9 and the movable scroll 11 are engaged with each other. With this engagement, the fixed scroll base plate 9*a*, the fixed scroll spiral wall 9*b*, the movable scroll base plate 11*a*, and the movable scroll spiral wall 11*b* form the compression chamber 45 between the fixed scroll 9 and the movable scroll 11. The compression chamber 45 communicates with the motor chamber 17 serving as the suction chamber through the first suction passage 3*c*, the second suction passage 9*e*, and the suction port 9*f*.

The elastic plate 47 made of a thin metal plate is disposed between the fixed scroll 9 and the shaft supporting housing 3 and between the movable scroll 11 and the shaft supporting housing 3. The movable scroll 11 is urged toward the fixed scroll 9 by a restoring force when the elastic plate 47 is elastically deformed.

The movable scroll base plate 11*a* cooperates with the elastic plate 47 to form a back pressure chamber 49 in the boss 3*a* of the shaft supporting housing 3. The back pressure chamber 49 communicates with the supply hole 11*d*.

In this compressor, the motor mechanism 7 is controlled by the inverter to operate, which rotates the driving shaft 5 around the driving axis O to rotate the movable scroll 11. Thus, the refrigerant flowing into the motor chamber 17 through the suction port 15*c* is sucked into the compression chamber 45 through the first suction passage 3*c*, the second suction passage 9*e*, and the suction port 9*f*. As a volume of the compression chamber 45 is reduced by the rotation of the movable scroll 11, the refrigerant in the compression chamber 45 is compressed. In addition, a part of the refrigerant with high pressure in the compression chamber 45 flows into the back pressure chamber 49 through the supply hole 11*d* by the rotation of the movable scroll 11, so that pressure in the back pressure chamber 49 becomes high. As a result, the movable scroll 11 is urged toward the fixed scroll 9 by the elastic plate 47 and the pressure in the back pressure chamber 49, which preferably seals the compression chamber 45.

The refrigerant with the high pressure compressed in the compression chamber 45 is discharged to the discharge chamber 35 through the discharge port 9*d*, and then, flows from the discharge chamber 35 to the oil separation chamber 13*c* through the discharge passage 13*e*. While lubricant oil is separated from the refrigerant with the high pressure in the oil separation chamber 13*c*, the refrigerant flows through the oil separation cylinder 21 and is discharged through the discharge port 13*f*. The lubricant oil separated from the refrigerant flows through a filter and an oil supply passage, which are not illustrated, to be supplied to sliding portions where the movable scroll 11 slides on the fixed scroll 9, or the like.

In this compressor having the above-described configuration, the motor housing 15 and the compression part housing 13 are fastened with the bolts 25. With this configuration, the heads 25*a* of the bolts 25 and the compression part housing 13 are in contact with each other, which electrically connects the bolts 25 to the compression part housing 13. In addition, the external threaded portions 25*c* of the bolts 25 are screwed into the internal screw holes 15*f* of the motor housing 15, which electrically connects the bolts 25 to the motor housing 15. As a result, the motor housing 15 and the compression part housing 13 are electrically connected through the bolts 25 to have the same electric potential.

The press-fitting portions 511 of the connecting pins 51 are press-fitted into the first pin holes 15*g* of the motor housing 15 and the protrusions 53 of the first contact portions 51*b* in each of the connecting pins 51 are in contact with the inner peripheral surface of the corresponding second pin hole 3*h* of the shaft supporting housing 3. With this configuration, the motor housing 15 and the shaft supporting housing 3 are electrically connected through the connecting pins 51 to have the same electric potential.

Thus, the motor housing 15, the shaft supporting housing 3, and the compression part housing 13 have the same electric potential through the connecting pins 51 and the bolts 25.

In this compressor, when the housing 1 is disassembled for maintenance or the like, the bolts 25 with which the compression part housing 13 and the motor housing 15 are fastened are firstly removed. Then, the compression part housing 13 is removed from the motor housing 15 and the shaft supporting housing 3. At this time, the outer diameter d of the second insertion portion 513 of each of the connecting pins 51 is smaller than the inner diameter of the corresponding third pin hole 13*h* of the compression part housing 13, that is, the second insertion portion 513 and the inner peripheral surface of the third pin hole 13*h* are not in contact with each other, so that the second insertion portion 513 is easily pulled out from the third pin hole 13*h*. This means that the connecting pins 51 do not interfere with a work of removing the compression part housing 13.

Next, the shaft supporting housing 3 is removed from the motor housing 15. The diameter D of the circumcircle C of the first contact portions 51*b* in the first insertion portion 512 of each of the connecting pins 51 is equal to the inner diameter of the corresponding second pin hole 3*h*, so that the first insertion portion 512 is removably inserted into the second pin hole 3*h*. Accordingly, the inner peripheral surface of the second pin hole 3*h* is not pressed by the elastic force in the first insertion portion 512, and thus, the connecting pins 51 do not interfere with a work of removing the shaft supporting housing 3. At this time, the press-fitting portion 511 of each of the connecting pins 51 is press-fitted to the corresponding first pin hole 15*g* of the motor housing 15 to be fixed therein, so that the connecting pins 51 do not come out from the motor housing 15.

Thus, the compression part housing 13 and the shaft supporting housing 3 are easily removed from the motor housing 15.

Therefore, in this compressor, the housing 1 as a whole has the same electric potential while an ease of disassembly of the housing 1 is maintained.

Figure 6:
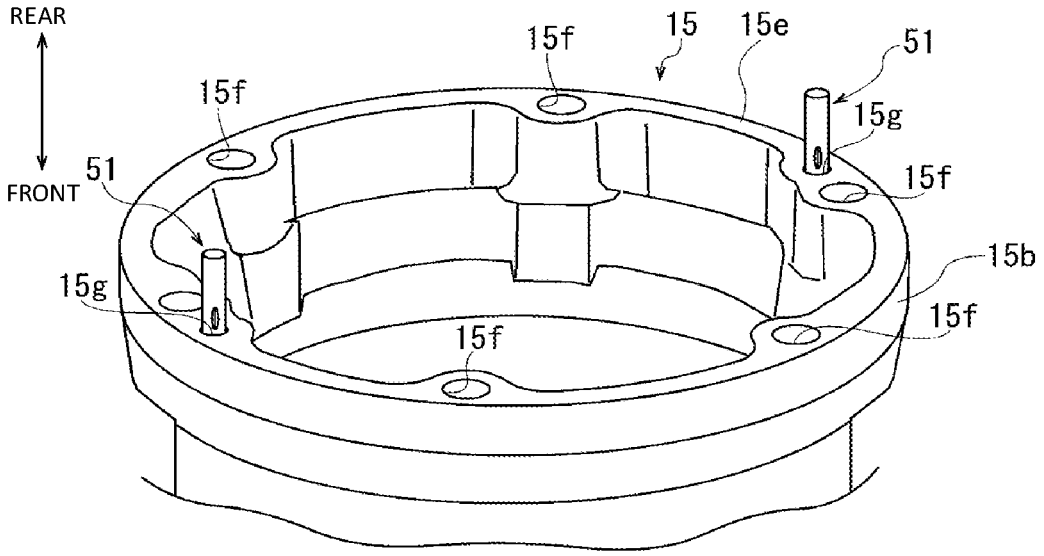
FIG. 6 is a perspective view partially illustrating a state in which the connecting pins are inserted into a first housing portion in the electric compressor according to the first embodiment.
Figure 7:
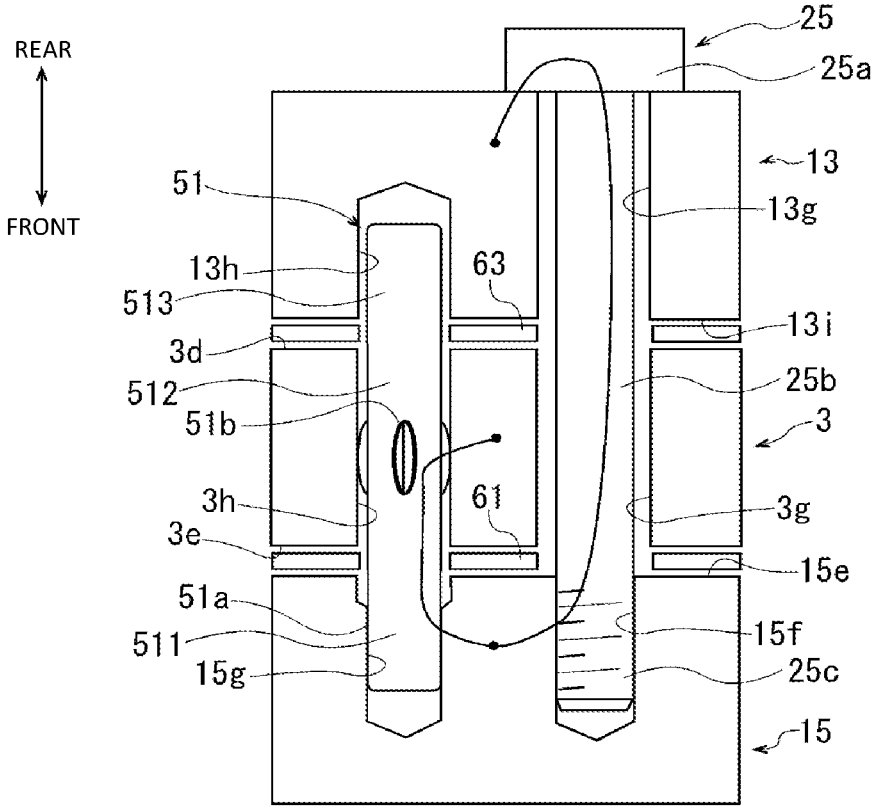
FIG. 7 is a schematic view for explaining that a housing as a whole has the same electric potential in the electric compressor according to the first embodiment.

Especially in this compressor, when the shaft supporting housing 3 and the compression part housing 13 are assembled to the motor housing 15, each of the connecting pins 51 suitably serves as a positioning pin. That is, when the housing 1 is assembled, the connecting pins 51 are firstly press-fitted into the first pin holes 15*g* of the motor housing 15, as illustrated in FIG. 6. This makes the connecting pins 51 fixed to the first pin holes 15*g* with a large holding force while the connecting pins 51 are stably maintained coaxially with the first pin holes 15*g*. Accordingly, positional accuracy and postures of the connecting pins 51 relative to the motor housing 15 becomes stable. As a result, the work of assembling the shaft supporting housing 3 and the compression part housing 13 to the motor housing 15 is easily and accurately performed, so that the ease of assembling the housing 1 is enhanced.

The first contact portions 51*b* of the connecting pins 51 each have the groove 52 and the pair of protrusions 53. With this configuration, the first contact portions 51*b* are easily formed by the metal stamping.

Furthermore, in each of the connecting pins 51, the three first contact portions 51*b* are formed at regular intervals in the circumferential direction of the outer peripheral surface 51*a*. With this configuration, the first contact portions 51*b* come in contact with the inner peripheral surface of each of the second pin holes 3*h* of the shaft supporting housing 3 with high certainty, so that the shaft supporting housing 3 and the connecting pins 51 are electrically connected with high certainty. This configuration easily makes a center of the circumcircle C of the first contact portions 51*b* coaxial with a center of the second pin hole 3*h*, which increases positional accuracy when the shaft supporting housing 3 is positioned relative to the motor housing 15.

Second Embodiment

Figure 8:
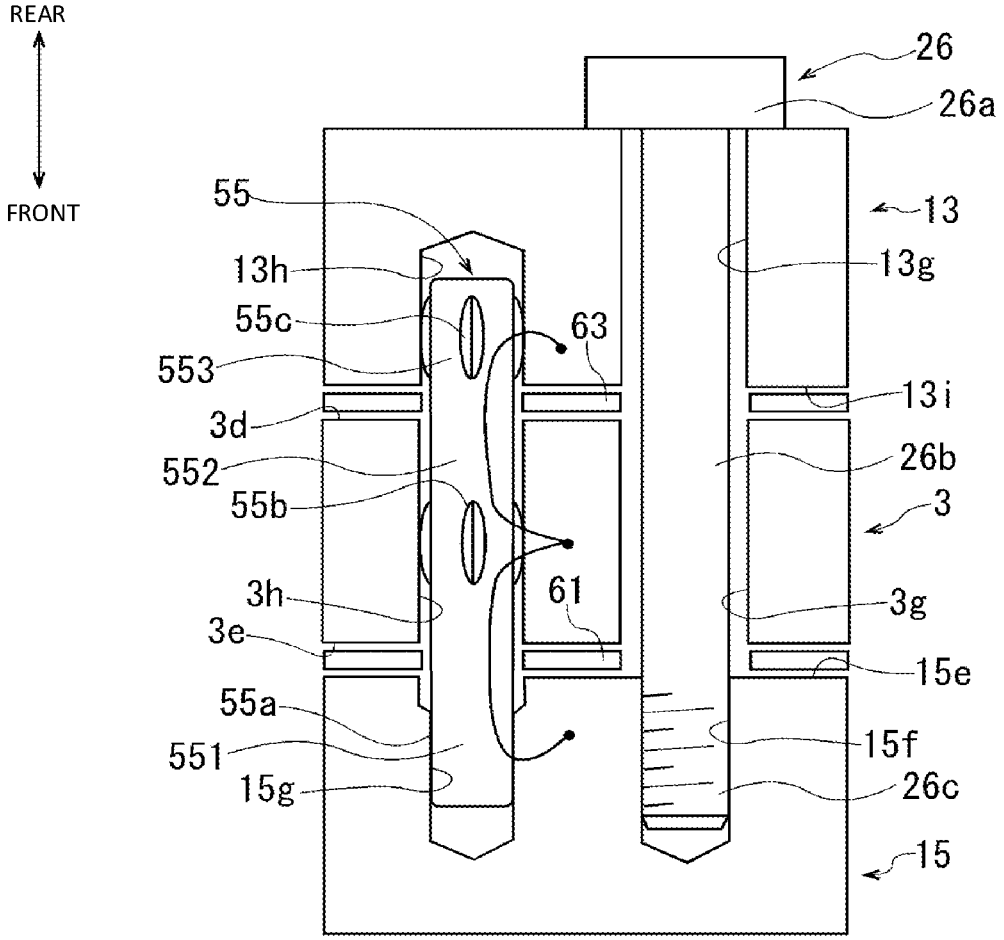
FIG. 8 is a schematic view for explaining that a housing as a whole has the same electric potential in an electric compressor according to a second embodiment.

As illustrated in FIG. 8, a compressor of a second embodiment is different in the configurations of the bolts 25 and the connecting pins 51 from the compressor in the first embodiment.

Bolts 26 in the compressor of the second embodiment are made of resin and have an insulation property. Similarly to the bolts 25, the bolts 26 each have a head 26*a*, a shank 26*b*, and an external threaded portion 26*c*.

Connecting pins 55 in this compressor are made of metal, and each have an outer peripheral surface 55*a* formed in a cylindrical shape with an outer diameter d, similarly to the connecting pins 51. Each of the connecting pins 55 has a press-fitting portion 551, a first insertion portion 552, and a second insertion portion 553 that are arranged in this order from one end to the other end of the connecting pin 55 in a longitudinal direction thereof.

The press-fitting portion 551 is formed as a so-called straight portion extending with the constant outer diameter d in the longitudinal direction of the connecting pin 55 and located in one end portion of the connecting pin 55 in the longitudinal direction thereof.

The first insertion portion 552 is formed in a middle portion of the connecting pin 55 in the longitudinal direction thereof. Three first contact portions 55*b* are formed on the outer peripheral surface 55*a* of the first insertion portion 552 and protrudes outwardly in a radial direction of the connecting pin 55 from the outer peripheral surface 55*a*. The three first contact portions 55*b* are arranged at regular intervals of 120 degrees in a circumferential direction of the outer peripheral surface 55*a*.

The second insertion portion 553 is formed in the other end portion of the connecting pin 55 in the longitudinal direction thereof. Three second contact portions 55*c* are formed on the outer peripheral surface 55*a* of the second insertion portion 553 and protrude outwardly in the radial direction of the connecting pin 55 from the outer peripheral surface 55*a*. The three second contact portions 55*c* are arranged at regular intervals of 120 degrees in the circumferential direction of the outer peripheral surface 55*a*.

The first contact portions 55*b* and the second contact portions 55*c* each have a groove and a pair of protrusions, similarly to the first contact portions 51*b* in the compressor of the first embodiment. A diameter D of a circumcircle C of the second contact portions 55*c* is equal to or smaller than a diameter D of a circumcircle C of the first contact portions 55*b*.

Similarly to the compressor of the first embodiment, the six internal screw holes 15*f* into which the external threaded portions 26*c* of the bolts 26 are screwed and the two first pin holes 15*g* into which the press-fitting portions 551 of the connecting pins 55 are press-fitted are formed in the motor housing 15.

Similarly to the compressor of the first embodiment, the first bolt insertion holes 3*g* into which the shanks 26*b* of the bolts 26 are inserted and the two second pin holes 3*h* with which the first contact portions 55*b* in the first insertion portion 552 of each of the connecting pins 55 come in contact are formed in the shaft supporting housing 3. Each of the second pin holes 3*h* is formed in a circle when viewed in a cross-sectional view, and has an inner diameter equal to the diameter D of the circumcircle C of the first contact portions 55*b* in the first insertion portion 552. With this configuration, the first insertion portion 552 and the second insertion portion 553 are removably inserted into the second pin hole 3*h*.

Similarly to the compressor of the first embodiment, the second bolt insertion holes 13*g* into which the shanks 26*b* of the bolts 26 are inserted and the two third pin holes 13*h* with which the second contact portions 55*c* in the second insertion portion 553 of each of the connecting pins 55 come in contact are formed in the compression part housing 13. In detail, the second contact portions 55*c*come in contact with the inner peripheral surface of each of the third pin holes 13*h*. Each of the third pin holes 13*h* is formed in a circle when viewed in a cross-sectional view, and has an inner diameter equal to the diameter D of the circumcircle C of the second contact portions 55*c* in the second insertion portion 553. With this configuration, the second insertion portion 553 is removably inserted into the third pin hole 13*h*.

In the compressor of the second embodiment, the bolts 26 with which the motor housing 15 and the compression part housing 13 are fastened have the insulation property. Accordingly, the motor housing 15 and the compression part housing 13 are not electrically connected with each other through the bolts 26.

In this regard, in this compressor, the second contact portions 55*c* in the second insertion portion 553 of each of the connecting pins 55 are in contact with an inner peripheral surface of the corresponding third pin hole 13*h* of the compression part housing 13. Similarly to the connecting pins 51 in the compressor of the first embodiment, the press-fitting portion 551 of each of the connecting pins 55 is press-fitted into the corresponding first pin hole 15*g* of the motor housing 15, and the first contact portions 55*b* in the first insertion portion 552 of each of the connecting pins 55 are in contact with the inner peripheral surface of the corresponding second pin hole 3*h* of the shaft supporting housing 3. With this configuration, the motor housing 15, the shaft supporting housing 3, and the compression part housing 13 are electrically connected through the connecting pins 55.

The inner diameter of each of the second pin holes 3*h* of the shaft supporting housing 3 is equal to the diameter D of the circumcircle C of the first contact portion 55*b* of the corresponding connecting pin 55, and equal to or larger than the diameter D of the circumcircle C of the second contact portions 55*c* of the connecting pin 55. With this configuration, the first insertion portion 552 and the second insertion portion 553 of each of the connecting pins 55 are removably inserted into the corresponding second pin hole 3*h* of the shaft supporting housing 3.

In addition, the inner diameter of each of the third pin holes 13*h* of the compression part housing 13 is equal to the diameter D of the circumcircle C of the second contact portions 55*c* of the corresponding connecting pin 55. With this configuration, the second insertion portion 553 of each of the connecting pins 55 is removably inserted into the corresponding third pin hole 13*h* of the compression part housing 13.

Thus, the shaft supporting housing 3 and the compression part housing 13 are easily removed from the motor housing 15.

The other configurations and advantageous effects in the compressor of the second embodiment are the same as those in the compressor of the first embodiment.

In the above description, the present disclosure has been described based on the first embodiment and the second embodiment. However, the present disclosure is not limited to the above-described first embodiment and the second embodiment, and may be modified as appropriate within the scope of the present disclosure.

In the compressors of the first embodiment and the second embodiment, the diameter of the circumcircle of the first contact portions is equal to the inner diameter of the second pin hole, and the diameter of the circumcircle of the second contact portions is equal to the inner diameter of the third pin hole; however, the present disclosure is not limited thereto. For example, the diameter of the circumcircle of the first contact portions (or second contact portions) is approximately equal to the inner diameter of the second pin hole (or third pin hole), and the first contact portions (or the second contact portions) may be weakly press-fitted into the second pin hole (or the third pin hole) with a small press-fitting allowance that does not interfere with the insertion and removal.

In the compressors of the first embodiment and the second embodiment, the motor housing 15, the shaft supporting housing 3, and the compression part housing 13 correspond to the first housing portion, the second housing portion, and the third housing portion, respectively; however, the present disclosure is not limited thereto. As long as the housing accommodates the compression mechanism and the motor mechanism, any number or any type of the first housing portion, the second housing portion, the third housing portion, or the like, which compose the housing, may be used.

For example, the compression part housing 13, the shaft supporting housing 3, and the motor housing 15 may correspond to the first housing portion, the second housing portion, and the third housing portion, respectively.

The present disclosure may be applied to a compressor in which the housing includes the motor housing 15, the compression part housing 13, and the first gasket 61 interposed between the motor housing 15 and the compression part housing 13, and the motor housing 15 and the compression part housing 13 are fastened by a fastening member having an insulation property, that is, the compressor not including the third housing portion. In this case, connecting pins are adopted, the connecting pins each having a press-fitting portion that is formed on one end portion of the connecting pin in the longitudinal direction thereof and a first insertion portion that is formed on the other end portion of the connecting pin in the longitudinal direction thereof and has the first contact portions, and the first insertion portion may removably inserted into each of the third pin holes 13*h* while the press-fitting portion is press-fitted into the corresponding first pin hole 15*g* of the motor housing 15 and the first contact portions are brought into contact with the third pin hole 13*h* of the compression part housing 13.

In addition, in the compressor of the second embodiment, the present disclosure may be applied to a compressor having a third gasket and a fourth housing portion made of metal, the third gasket interposed between the compression part housing 13 and the fourth housing portion. In this compressor, the fourth housing portion and the motor housing 15 only need to have the same electric potential by forming third bolt insertion holes into which the shanks 25*b* of the bolts 25 made of metal are screwed in the fourth housing portion so as to extend through the fourth housing portion and fastening the fourth housing portion and the motor housing 15 with the bolts 25 instead of the bolts 26 having the insulation property.

In the compressors of the first embodiment and the second embodiment, the number of the connecting pins 51 or the connecting pins 55 is two; however, the present disclosure is not limited thereto. The number of the connecting pins may be one or may be three or more.

In the compressors of the first embodiment and the second embodiment, the first contact portions and the second contact portions each have the groove 52 and the pair of protrusions 53; however, the present disclosure is not limited thereto. Shapes of the first contact portions or the second contact portions only need to protrude from the outer peripheral surface in the first contact portions or the second contact portions outwardly in the radial direction of the connecting pin and be brought into contact with the inner peripheral surface of the second pin hole or the third pin hole. For example, the first contact portions and the second contact portions each may be formed of a simple protrusion without a groove.

In the compressors of the first embodiment and the second embodiment, the number of the first contact portions or second contact portions is three; however, the present disclosure is not limited thereto. The number of the first contact portions or the second contact portions may be one, two, or four or more.

In the compressors of the first embodiment and the second embodiment, a scroll type compression mechanism is adopted as the compression mechanism; however, other types of compression mechanism such as a vane type or a swash plate type may be adopted.

The following technical ideas are also obtained in view of the present specification.

Supplementary Note 1

In an electric compressor including a housing accommodating a compression mechanism and a motor mechanism, the housing includes: a first housing portion made of metal, the first housing portion having a first joint surface and a first pin hole formed in the first joint surface; a second housing portion made of metal, the second housing portion having a second joint surface that faces the first joint surface and a second pin hole formed in the second joint surface at a position where the second pin hole faces the first pin hole; a connecting pin made of metal, the connecting pin having: a press-fitting portion press-fitted into the first pin hole; and a first insertion portion having a first contact portion protruding from an outer peripheral surface of the first insertion portion and removably inserted into the second pin hole, the first contact portion being in contact with an inner peripheral surface of the second pin hole; and a first gasket having an insulation property, the first gasket having a first pin insertion hole through which the connecting pin is inserted, the first gasket being interposed between the first joint surface and the second joint surface.

Supplementary Note 2

In the electric compressor according to supplementary note 1, the second pin hole extends through the second housing portion, the second housing portion has a third joint surface that is opposite to the second joint surface, the housing further has: a third housing portion made of metal, the third housing portion having a fourth joint surface that faces the third joint surface and a third pin hole formed in the fourth joint surface at a position where the third pin hole faces the second pin hole; a second gasket having an insulation property, the second gasket having a second pin insertion hole through which the connecting pin is inserted, the second gasket being interposed between the third joint surface and the fourth joint surface; and a fastening member made of metal, the fastening member fastening the first housing portion and the third housing portion with the second housing portion interposed between the first housing portion and the third housing portion, the connecting pin further has a second insertion portion disposed opposite to the press-fitting portion across the first insertion portion in a longitudinal direction of the connecting pin, and the second insertion portion has an outer diameter smaller than an inner diameter of the third pin hole.

Supplementary Note 3

In the electric compressor according to supplementary note 1, the second pin hole extends through the second housing portion, the second housing portion has a third joint surface that is opposite to the second joint surface, the housing further has: a third housing portion made of metal, the third housing portion having a fourth joint surface that faces the third joint surface and a third pin hole formed in the fourth joint surface at a position where the third pin hole faces the second pin hole; and a second gasket having an insulation property, the second gasket having a second pin insertion hole through which the connecting pin is inserted, the second gasket being interposed between the third joint surface and the fourth joint surface, the connecting pin further has a second insertion portion disposed opposite to the press-fitting portion across the first insertion portion in a longitudinal direction of the connecting pin, and the second insertion portion has a second contact portion protruding from the outer peripheral surface of the second insertion portion and is removably inserted into the third pin hole, the second insertion portion being in contact with an inner peripheral surface of the third pin hole. Supplementary Note 4

In the electric compressor according to any one of supplementary notes 1 to 3, the first contact portion has a groove recessed in the outer peripheral surface of the connecting pin and a pair of protrusions protruding from the outer peripheral surface and arranged side by side in a circumferential direction of the connecting pin with the groove interposed between the pair of protrusions.

Supplementary Note 5

In the electric compressor according to any one of supplementary notes 1 to 4, the first contact portion includes a plurality of first contact portions.

Supplementary Note 6

In the electric compressor according to supplementary note 5, the plurality of first contact portion are arranged at regular intervals in the circumferential direction of the connecting pin.

Industrial Applicability

The present disclosure is applicable to an air conditioner for vehicles, or the like.

What is claimed is:

1. An electric compressor comprising a housing accommodating a compression mechanism and a motor mechanism, the housing including a first metal housing portion, a second metal housing portion, a metal connecting pin, and a first gasket, the first metal housing portion having a first joint surface and a first pin hole formed in the first joint surface, and the second metal housing portion having a second joint surface that faces the first joint surface and a second pin hole formed in the second joint surface at a position where the second pin hole faces the first pin hole, wherein the metal connecting pin having:

a press-fitting portion press-fitted into the first pin hole; and a first insertion portion having a first contact portion protruding from an outer peripheral surface of the first insertion portion and removably inserted into the second pin hole, the first contact portion being in contact with an inner peripheral surface of the second pin hole, and the first gasket has an insulation property, the first gasket having a first pin insertion hole through which the metal connecting pin is inserted, the first gasket being interposed between the first joint surface and the second joint surface.

2. The electric compressor according to claim 1, wherein the second pin hole extends through the second metal housing portion, the second metal housing portion has a third joint surface that is opposite to the second joint surface, the housing further has:

a third metal housing portion having a fourth joint surface that faces the third joint surface and a third pin hole formed in the fourth joint surface at a position where the third pin hole faces the second pin hole;

a second gasket having an insulation property, the second gasket having a second pin insertion hole through which the metal connecting pin is inserted, the second gasket being interposed between the third joint surface and the fourth joint surface; and a metal fastening member fastening the first metal housing portion and the third metal housing portion with the second metal housing portion interposed between the first metal housing portion and the third metal housing portion, the metal connecting pin further has a second insertion portion disposed opposite to the press-fitting portion across the first insertion portion in a longitudinal direction of the metal connecting pin, and the second insertion portion has an outer diameter smaller than an inner diameter of the third pin hole.

3. The electric compressor according to claim 1, wherein the first contact portion has a groove recessed in the outer peripheral surface of the metal connecting pin and a pair of protrusions protruding from the outer peripheral surface and arranged side by side in a circumferential direction of the metal connecting pin with the groove interposed between the pair of protrusions.

4. The electric compressor according to claim 1, wherein the first contact portion includes a plurality of the first contact portions.

5. The electric compressor according to claim 4, wherein the plurality of the first contact portions are arranged at regular intervals in a circumferential direction of the connecting pin.

6. The electric compressor according to claim 1, wherein the second pin hole extends through the metal second housing portion, the second metal housing portion has a third joint surface that is opposite to the second joint surface, the housing further has:

a third metal housing portion having a fourth joint surface that faces the third joint surface and a third pin hole formed in the fourth joint surface at a position where the third pin hole faces the second pin hole; and a second gasket having an insulation property, the second gasket having a second pin insertion hole through which the metal connecting pin is inserted, the second gasket being interposed between the third joint surface and the fourth joint surface, the metal connecting pin further has a second insertion portion disposed opposite to the press-fitting portion across the first insertion portion in a longitudinal direction of the metal connecting pin, and the second insertion portion has a second contact portion protruding from an outer peripheral surface of the second insertion portion and is removably inserted into the third pin hole, the second insertion portion being in contact with an inner peripheral surface of the third pin hole.

* * * * *